United States Patent [19]

Crisp, Jr. et al.

[11] Patent Number: 4,607,870

[45] Date of Patent: Aug. 26, 1986

[54] DOOR SECURITY DEVICE

[76] Inventors: Edward T. Crisp, Jr., 241 Ronnie La., Temple, Ga. 30179; Willard M. Davidson, Jr., 3733 Shady Grove, Carrollton, Ga. 30117

[21] Appl. No.: 774,158

[22] Filed: Sep. 9, 1985

[51] Int. Cl.[4] ..... E05C 17/44

[52] U.S. Cl. ..... 292/338; 297/DIG. 15

[58] Field of Search ..... 292/338, DIG. 15, DIG. 49, 292/339, 262

[56] References Cited

U.S. PATENT DOCUMENTS

| | | | |
|---|---|---|---|
| 561,373 | 6/1896 | Campbell | 292/338 X |
| 1,069,676 | 8/1913 | Clement | 292/338 |
| 1,505,184 | 8/1924 | Zukor | 292/338 |
| 1,879,119 | 9/1932 | Dauble | 292/338 |
| 1,944,783 | 1/1934 | Ciriacy et al. | 292/338 |
| 4,019,765 | 4/1977 | Nichola | 248/354.6 X |

*Primary Examiner*—Richard E. Moore

*Attorney, Agent, or Firm*—Jones & Askew

[57] ABSTRACT

A security device for mounting to a door, the device having a floor-contacting member to prevent the door from being forced open when the device is engaged. The device is slidably and pivotably mounted to the face of the door so as to be engageable and disengageable with one hand without excessive bending or stooping. When not in use, the device stores flush against the lower portion of the door.

9 Claims, 13 Drawing Figures

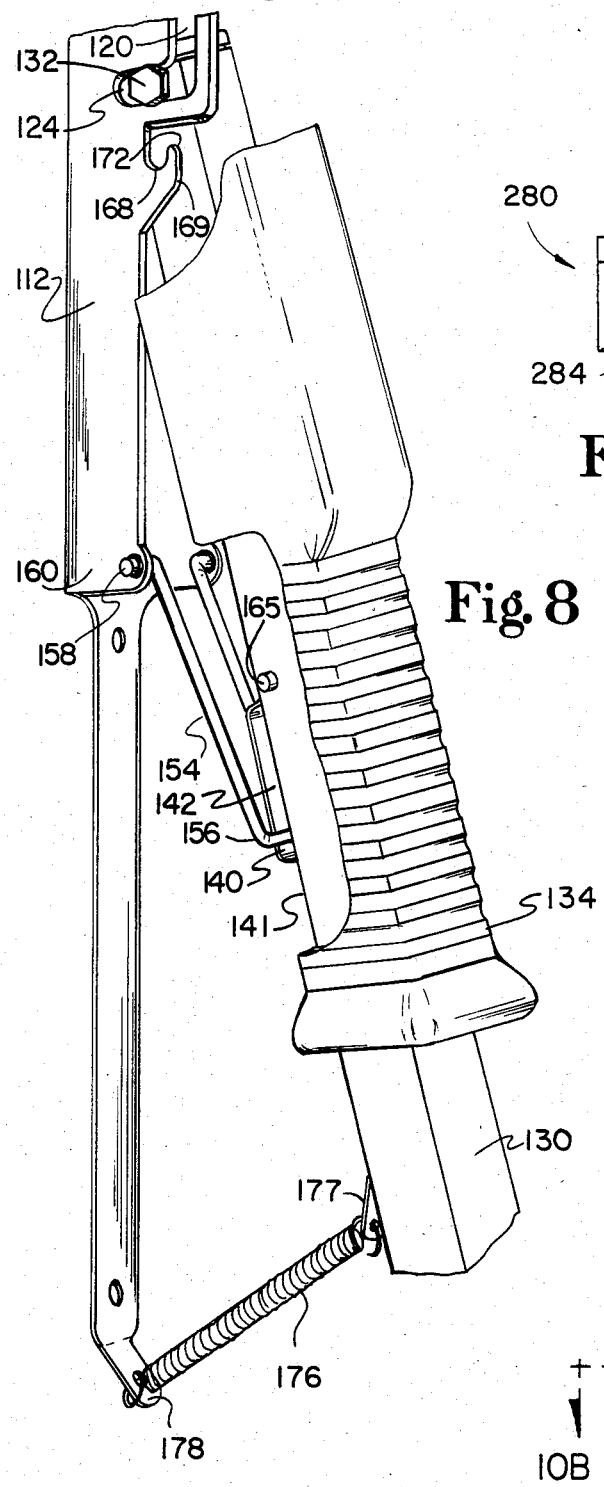
Fig. 8
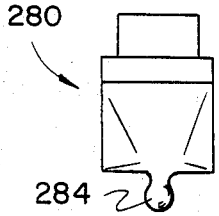
Fig. 9A
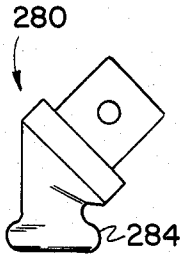
Fig. 9B
Fig. 10B
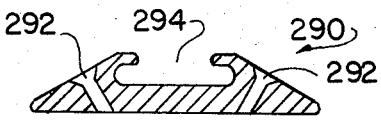
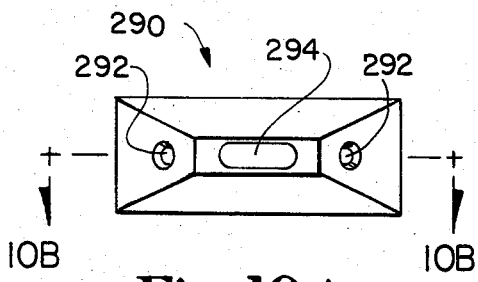
Fig. 10A

DOOR SECURITY DEVICE

TECHNICAL FIELD

The present invention relates generally to security devices, and relates more specifically to a security device for mounting to the face of a door which can secure the door firmly against opening as a means of protecting persons behind the door.

BACKGROUND OF THE INVENTION

Door securing devices which attach to the inner face of a door and project downwardly to engage the floor and prevent the door from being forced open are known in the art. One such example is disclosed in U.S. Pat. No. 1,944,783 and comprises a leg hingably mounted at its upper end to a bracket secured to the face of the door. When not in use, the device folds upwardly against the face of the door and is held in place by a clip. When it is desired to engage the security device, the bar is swung downwardly through an arc of approximately 150 degrees until its lower end engages the floor. This device suffers the disadvantages of preempting the face of the door above the mounting bracket, and of requiring the user to bend down to nearly floor level or to maneuver the device with his foot in order to disengage it.

Another example is disclosed in U.S. Pat. No. 4,019,765, wherein a door guard has a hook-shaped portion, the lower end of which is slidably received into the upper end of a hollow tube. A floor-engaging rod member is telescopically received into the lower end of the hollow tube. To install the door guard, the hook is attached to the doorknob, and the rod member is extended to engage the floor. When extended to the proper length, the rod member is locked into position. An optional bar may be fastened to the rod member near its lower end and fastened against the doorjamb to further secure the guard. However, this device suffers the disadvantage of having to be completely removed from the door before the door may be opened. The device must then be stored until ready for re-use and re-installed to secure the door again.

SUMMARY OF THE INVENTION

As will be seen, the door security device of the present invention overcomes these and other disadvantages associated with prior art door security devices. Stated generally, the door security device of the present invention comprises a floor engaging member hingably and slidably mounted to the face of the door and fastened into the lock stile. The device can be engaged and disengaged with one hand and without excessive bending or stooping, and without awkward foot maneuvers. Further, the device stores flush against the face of the door out of the way when not in use.

Stated more specifically, the door security device of the present invention includes a mounting bracket mounted on the face of the door and anchored into the lock stile and including two parallel arms projecting perpendicularly therefrom. Elongated vertical slots are formed in each bracket arm. A shaft is mounted to the bracket between the parallel arms by means of a pivot pin extending through the upper end of the shaft, which pin is received into the vertical slots. A floor-engaging foot is mounted at the lower end of the shaft.

One end of a control rod is pivotably mounted at a position intermediate the mounting bracket and the bottom of the door. A mounting pin in the other end of the control rod is slidably received in a groove of a shaft slide mounted to the face of the shaft adjacent the door.

A spring, one end of which is secured to the shaft, and the other end of which is secured to the face of the door, applies downward tension to the shaft. Because of this downward tension, the control rod mounting pin is maintained against the upper end of the groove of the shaft slide, initially supporting the shaft against downward motion. However, when the shaft is pivoted outwardly such that the angle of the control rod relative to the shaft slide passes approximately 90 degrees, the control rod mounting pin slides to the lower end of the groove. The downward force exerted by the spring can then pull the shaft downwardly, the shaft mounting pin sliding downwardly within the vertical slots until the lower end of the shaft is brought into engagement with the floor. When latched into place, the device bears against the floor to prevent the door from being forced open.

Thus, it is an object of the present invention to provide a door security device which will protect the persons inside a room from forced entry.

It is a further object of the present invention to provide a door security device which can be quickly and easily engaged and released.

It is yet another object of the present invention to provide a door security device which need not be removed from the door in order to open the door.

These and other objects, features, and advantages of the present invention will become apparent upon reading the following specifications when taken in conjunction with the drawing and the appended claims.

BRIEF DESCRIPTION OF THE DRAWING

FIG. 8 is a partial cut-away perspective view of the door security device shown in FIG. 6.

FIG. 9A is a front view of an alternate disclosed embodiment of a foot member for a door security device.

FIG. 9B is a side view of the foot member of FIG. 9A.

FIG. 10A is a top view of a floor-mounted anchor for receiving the foot member of FIG. 9A.

FIG. 10B is a side cross-sectional view of the anchor of FIG. 10A taken along section line 10B—10B of FIG. 10A.

DETAILED DESCRIPTION OF THE DISCLOSED EMBODIMENT

Figure 1:
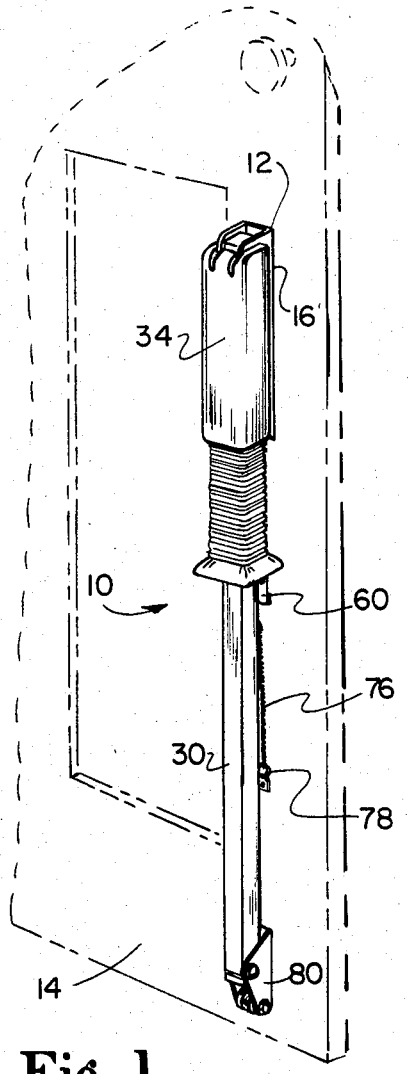
FIG. 1 is a pictorial view of a disclosed embodiment of the door security device of the present invention mounted on the face of a door and in a retracted position.
Figure 2:
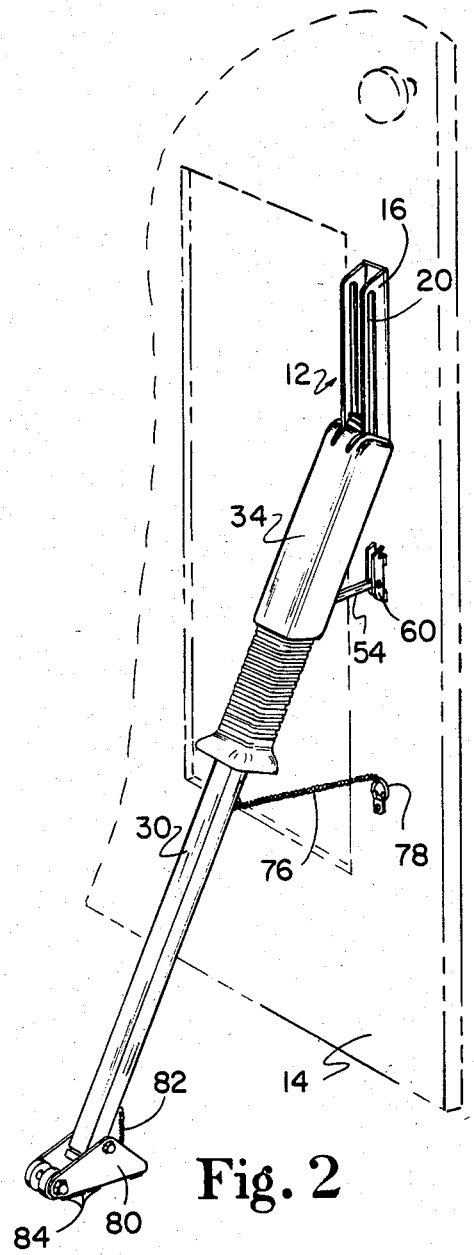
FIG. 2 is a pictorial view of the door security device of FIG. 1 shown in an extended position.

Referring now in more detail to the drawing, in which like numerals indicate like elements throughout the several views, FIG. 1 shows a door security device 10 in accordance with the present invention. A mounting bracket 12 having a generally U-shaped cross-section is mounted to the face of the door 14 with the two parallel arms 16, 18 of the bracket projecting perpendicularly from the face of the door. Vertical elongated slots 20, 22 are formed in the bracket arms 16, 18. The slots 20, 22 are equipped with shoulders 24, 26 formed at their lower ends. The mounting bracket 12 is secured to the face of the door 14 in a conventional manner, such as by screws fastened into the lock stile (not shown).

Figure 5:
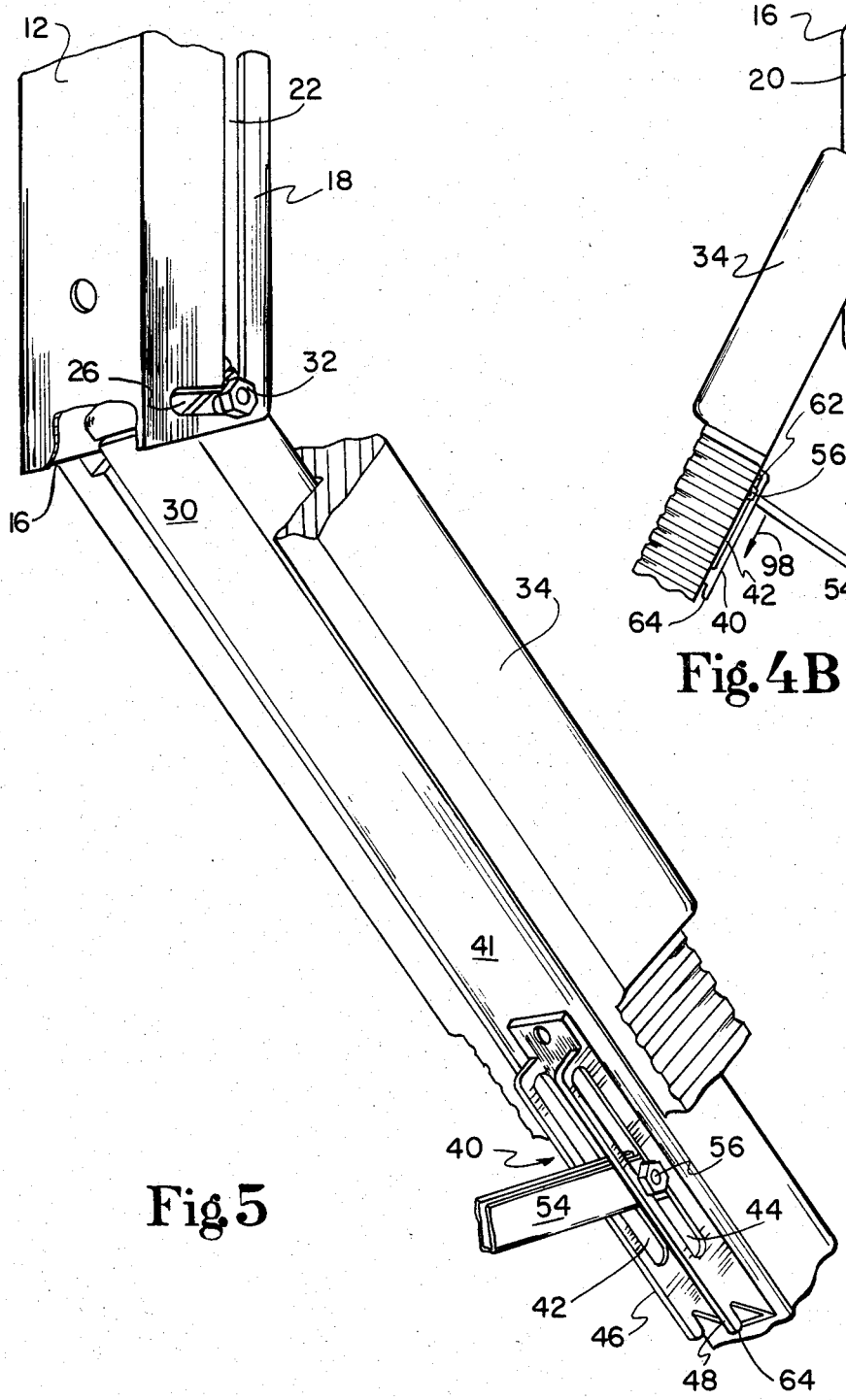
FIG. 5 is a pictorial view of the upper back section of the door security device.
Figure 4B:
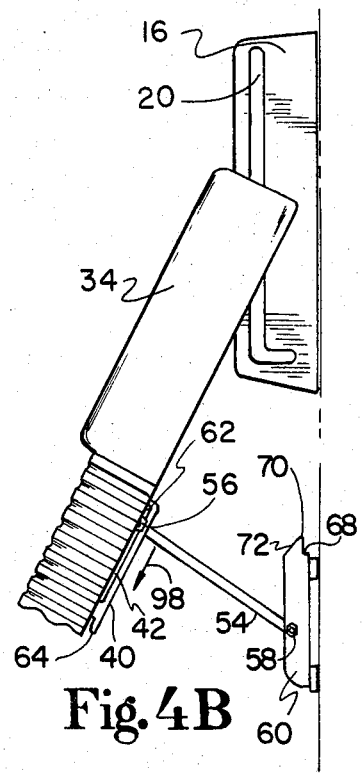
FIG. 4B is a partial side view of the door security device of FIG. 1 shown in a partially extended configuration.

A shaft 30 having a generally square cross-section is attached to the mounting bracket 12 between the bracket arms 16, 18 by a pin 32 (FIG. 5) extending laterally through the shaft and engaging the slots 20, 22 in the bracket arms such that the shaft can both pivot and slide relative to the mounting bracket. A hollow handle 34 encases the upper end of the shaft and conceals the mounting hardware from view. In addition, the handle protects the mechanism and user from accidental injury during operation.

An elongated shaft slide 40 (FIG. 5) having a U-shaped cross section is mounted to the face 41 of the shaft 30 adjacent the face of the door 14. Elongated guide slots 42, 44 generally parallel to the longitudinal axis of the shaft slide 40 are formed in the parallel outwardly depending portions or arms 46, 48 of the shaft slide. One end of a control rod 54 is mounted between the arms 46, 48 of the shaft slide by a slide pin 56 extending laterally through the control rod and engaging the guide slots 42, 44. The control rod 54 thus mounted can both pivot and slide relative to the shaft slide 40.

The opposite end of the control rod 54 is pivotably mounted on a pivot pin 58 in a control rod bracket 60 fastened to the face of the door 14 at a point intermediate the mounting bracket 12 and the bottom of the door. The control rod bracket 60 is positioned such that, when the shaft 30 is positioned flush with the face of the door 14, the mounting pin 56 in the control rod 54 is disposed in the uppermost end 62 of the guide slot 42.

A flange 64 formed on the bottom outside edge of the shaft slide 40 cooperatively engages an indentation 68 defined by a lip 70 on the upper inside edge of the control rod bracket 60, so that the shaft 30 is held in place when stowed against the face of the door 14. By lifting the shaft upwardly, the flange 64 can be disengaged from the indentation 68. As the shaft 30 is folded against the face of the door 14, a beveled upper edge 72 of the control rod bracket 60 urges the flange 64 upwardly over the lip 70 and into the indentation 68 for proper engagement.

One end of a tension spring 76 is attached to a spring mounting bracket 78 mounted to the face of the door 14 at a point intermediate the control rod bracket 60 and the bottom of the door. The other end of the spring 76 is mounted to the face 41 of the shaft 30 at a point higher than the mounting point of the spring mounting bracket 78 on the face of the door 14 so that the tension of the spring urges the shaft downwardly and inwardly toward the face of the door.

Figure 3:
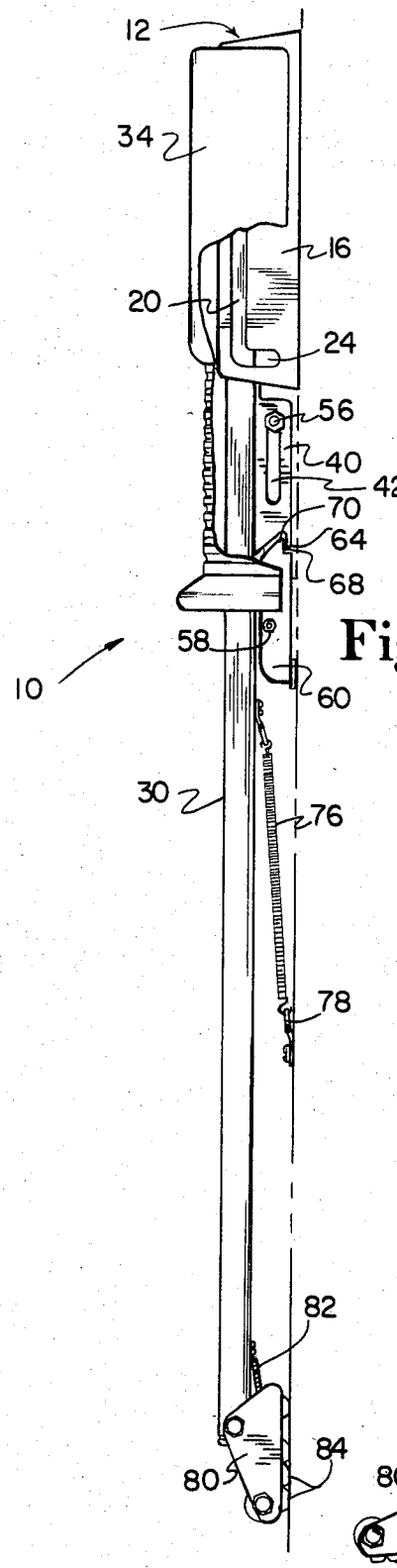
FIG. 3 is a partial cut-away side view of the door security device shown in FIG. 1.
Figure 4A:
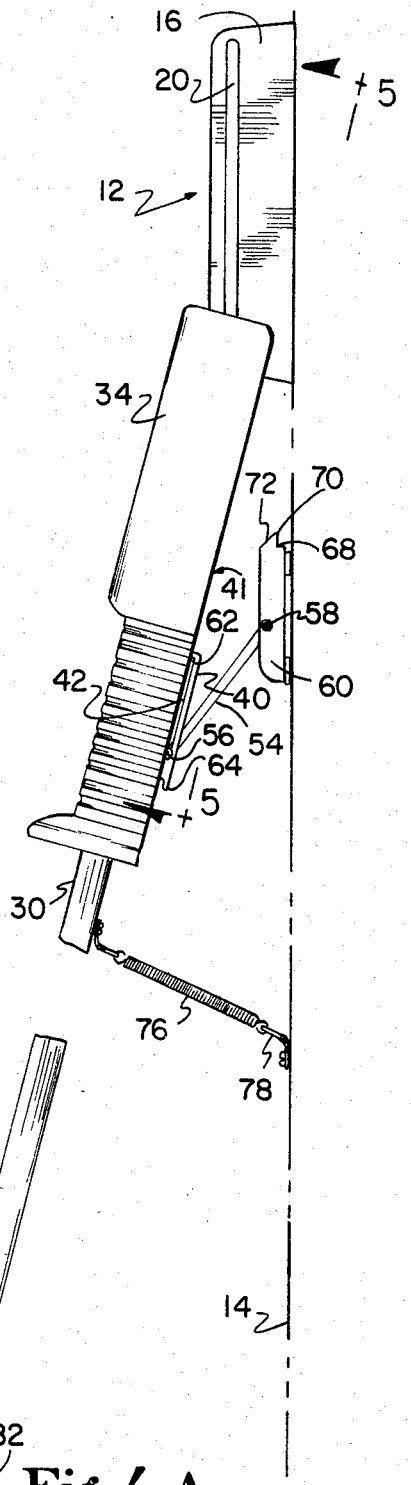
FIG. 4A is a side view of the door security device shown in FIG. 2.
Figure 4A:
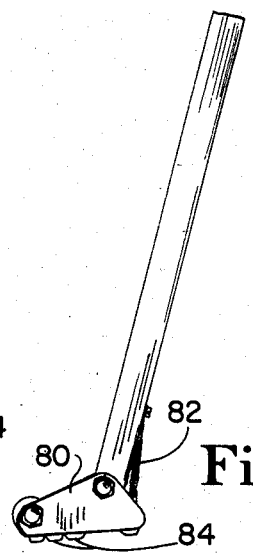

A floor-engaging foot 80 is pivotally mounted on a pivot pin 81 at the lower end of the shaft 30. A tension spring 82 keeps the foot 80 retracted when not engaging the floor, as shown in FIG. 3. When the security device is engaged, pressure of the shaft 30 against the floor causes the foot 80 to pivot about the pin 81, bringing friction members 84, such as a rubber tread, on the bottom of the foot into contact with the floor.

To operate the door security device 10 of the present invention mounted to the inner face of the door as described above, the user closes the door, grasps the handle 34, and pulls upwardly and outwardly. The upward force lifts the flange 64 on the lower end of the shaft slide 40 up and over the lip 70 on the upper edge of the control rod mounting bracket 60 and out of the indentation 68. The outward force causes the control rod 54 to swing about its pivot pin 58. At the same time, the tension spring 76 pulls the shaft 30 downwardly, causing the shaft mounting pin 32 to slide downwardly in its slots 20, 22. The tension of the spring 76 urging the shaft downwardly and inwardly keeps the control arm slide pin 56 forced against upper end of the shaft slide slots 42, 44 while the control rod 54 is in its first approximately 90 degrees of movement about its pivot pin 58. The control arm 54 also pushes the shaft 30 outwardly from the face of the door 14. As the shaft 30 extends outwardly from the face of the door 14, the foot 80 is maintained in a position above the floor.

As the angle of the control rod 54 relative to the shaft slide 40 passes the perpendicular, the downward and inward tension applied by the spring 76 causes the control arm slide pin 56 to slide down the shaft slide slots 42, 44 in the direction indicated by the arrow 98. With the control arm slide pin 56 no longer acting against the upper end of the shaft slide slots 42, 44, the tension of the spring 76 pulls the shaft 30 downwardly, the shaft mounting pin 32 sliding downwardly in its slots 20, 22 until the floor-engaging foot 80 contacts the floor. The contact with the floor causes the foot to pivot upon its pin 81, bringing the friction members 84 on the bottom of the foot into contact with the floor. The friction members prevent the foot from skidding across the floor in response to forces against the door. The downward and inward force applied by the tension spring 76 pulls the shaft 30 inwardly, thereby urging the shaft mounting pin 32 into the shoulders 24, 26 at the bottom of the slots 20, 22 to lock the shaft 30 in place.

It will be appreciated by those skilled in the art that the shaft mounting pin 32 will normally tend to engage the shoulders 24, 26 at the bottom of the slots 20, 22 when the floor engaging foot 80 comes into contact with the floor, even without the force applied by the tension spring 76, due to the angle and weight of the shaft 30 causing the shaft to pivot about the foot mounting pivot pin 81. However, the inward tension of the spring serves the further function of maintaining the shaft mounting pin 32 securely within the shoulders 24, 26, so that a potential intruder cannot dislodge the pin from the shoulders by shaking the door and thus disengage the security device.

To retract the door security device, the user grasps the handle 34 and pulls outwardly to disengage the shaft mounting pin 32 from the shoulders 24, 26 at the bottom of the slots 22, 24. The user then pulls upwardly against the tension of the spring 76, causing the control rod 54 to swing upwardly about its pivot pin 58. The shaft mounting pin 32 slides upwardly within its slots 20, 22, and the foot 80 is raised off the floor. As the foot 80 loses contact with the floor, the tension spring 82 urges the foot into the retracted position shown in FIG. 3.

As the angle of the control rod 54 relative to the shaft slide 40 passes the perpendicular, the inward force exerted by the tension spring 76 causes the control arm slide pin 56 to slide upwardly to the top of the slots 42, 44. As the shaft is lifted further, the arcuate movement of the control rod 54 pulls the shaft 30 toward the face of the door 14. The flange 64 on the bottom of the shaft slide 40 contacts the beveled upper edge 72 of the control rod bracket 60, thereby urging the flange up and over the lip 70. As the flange 64 passes over the lip 70, the downward force exerted by the tension spring 76 pulls the flange downwardly into the indentation 68, thereby latching the device against the face of the door 14.

It will be appreciated that when an intruder attempts to force open a door secured by the device 10 of the present invention, the pivoting motion of the shaft 30 about the foot mounting pivot pin 81 and about the shaft mounting pin 32 urges the door upwardly against the door frame. Thus, to force open the door, an intruder would have to overcome not only the friction of the foot 80 against the floor but also the wedging action of the top of the door against the door frame.

In order for the various components of the door security device 10 to interact in the desired manner, it is necessary that the device be installed on the face of the door 14 with the components in proper relation to one another. For example, as previously disclosed, the control rod bracket 60 must be fastened to the face of the door 14 a distance below the mounting bracket 12 such that, when the shaft 30 is positioned flush with the face of the door, the mounting pin 56 on the control rod 54 is disposed in the uppermost end 62 of the guide slot 48. Similarly, the mounting bracket 78 by which the end of the tension spring 76 is attached to the face of the door 14 must be disposed below the point on the face 41 of the shaft 30 where the opposite end of the spring is attached so that the spring will properly urge the shaft downwardly and inwardly. Improper positioning of the control rod bracket 60 or the tension spring mounting bracket 78 during installation could result in improper operation of the door security device.

Figure 6:
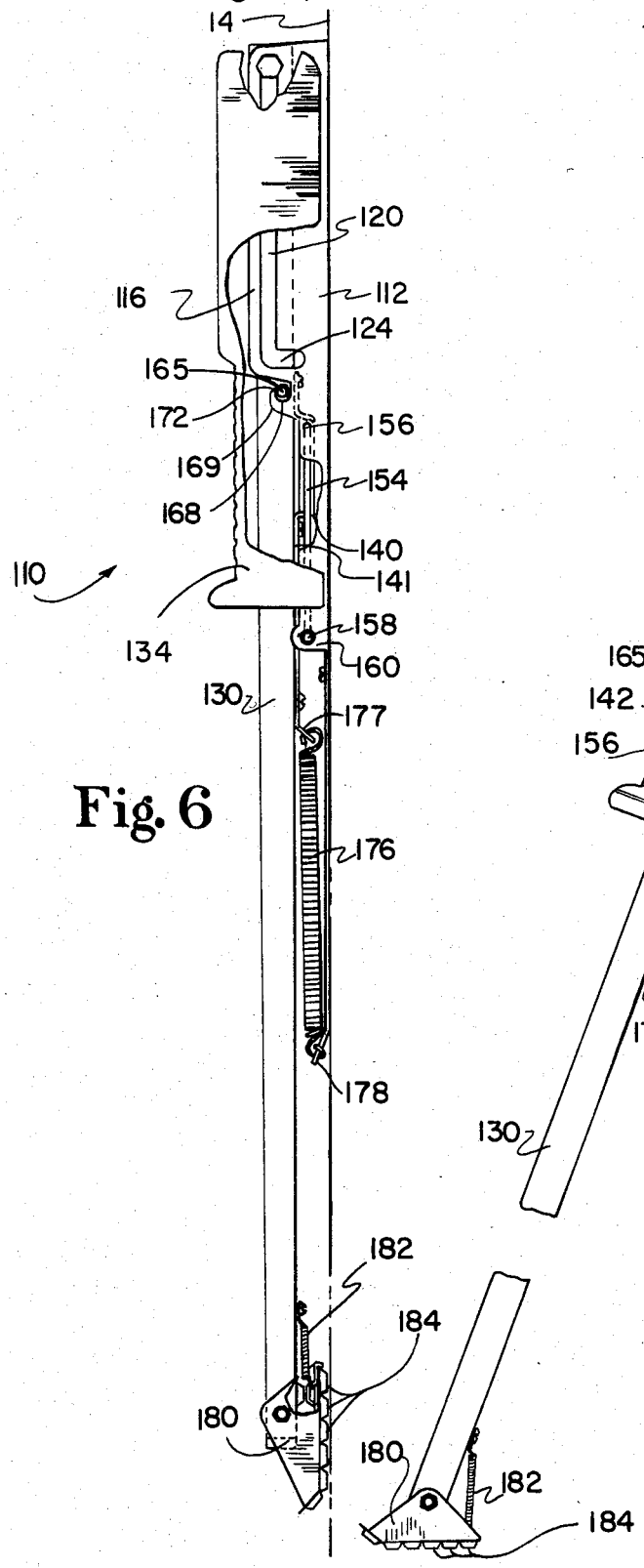
FIG. 6 is a partially cut-away side view of an alternate disclosed embodiment of the door security device of the present invention.
Figure 7:
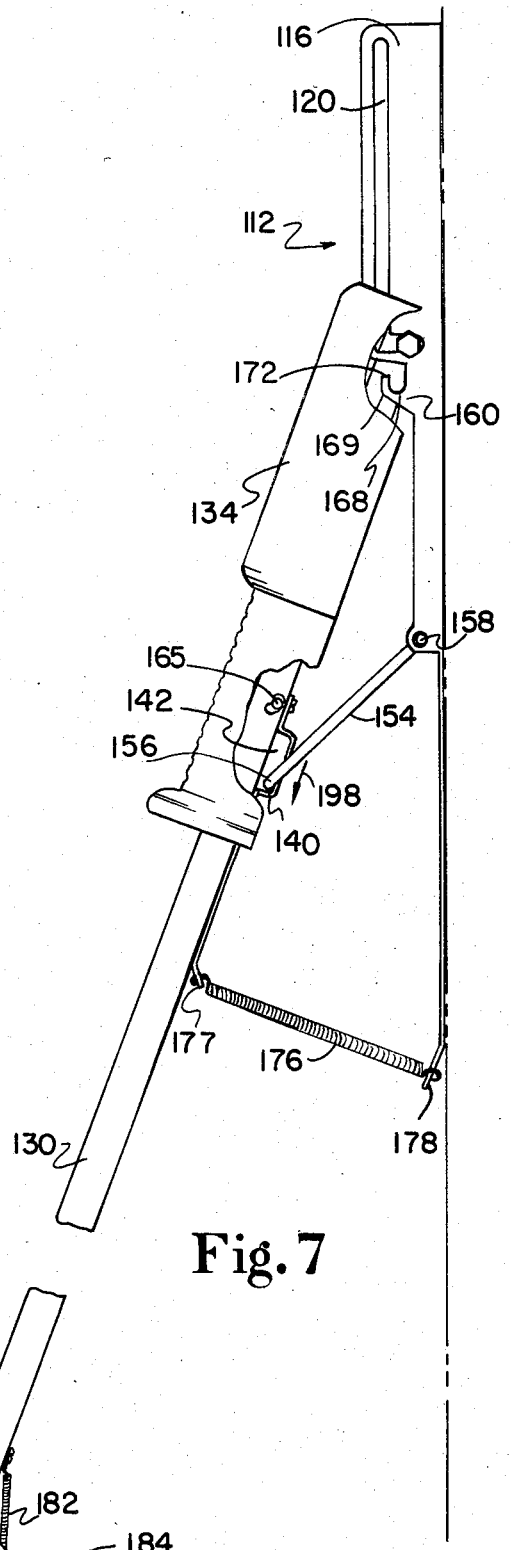
FIG. 7 is a pictorial view of the door security device of FIG. 6 shown in an extended position.

Accordingly, a second embodiment of a door security device 110, as shown in FIGS. 6–8, is disclosed herein which avoids the possibility of improperly positioning the components of the device relative to one another. A one-piece mounting bracket 112 is mounted to the face of the door 14 and fastened into the lock stile (not shown) in a conventional manner. While only one side of the mounting bracket 112 can be seen in FIGS. 6–7, it will be understood that the bracket is generally symmetrical along either side of a vertical center line, and that all of the features shown in FIGS. 6–7 for one side of the bracket exist in mirror image on the opposite side of the bracket.

A shaft mounting bracket arm 116 formed in the mounting bracket 112 depends outwardly from one vertical edge of the bracket. At a point on the mounting bracket 112 below the shaft mounting bracket arm 116 is a control rod mounting bracket 160. And, at the bottom of the one-piece mounting bracket 112 is a tension spring mounting bracket 178. By combining the shaft mounting bracket arm 116, the control rod mounting bracket 160, and the tension spring mounting bracket 178 on a one-piece bracket 112, the dimensional relations between these components are fixed, thereby greatly reducing the possibility of the door security device not functioning properly as a result of improper installation.

As with the previously disclosed first embodiment 10, the shaft mounting bracket arm 116 defines an elongated slot 120 having a shoulder 124 formed at its lower end. A shaft 130 having a generally square cross section is attached to the mounting bracket 112 between the bracket arm 116 and the parallel bracket arm (not shown) on the opposite side of the bracket 112 by a pin 132 extending laterally through the shaft and engaging the slots 120 in the shaft mounting bracket arms. In this manner, the shaft 130 can both pivot and slide relative to the mounting bracket 112. A hollow handle 134 encases the upper end of the shaft and conceals the mounting hardware from view.

An elongated shaft slide 140 is mounted to the face 150 of the shaft 130 adjacent to the face of the door 14. The width of the shaft slide is narrow enough to fit between the parallel shaft mounting bracket arms 116 when the shaft is retracted against the face of the door 14. A guide slot 142 is defined between the shaft slide 140 and the face 141 of the shaft 130, and the loop end 156 of a generally U-shaped control rod 154 is received within the guide slot. In this manner, the control rod 154 can both pivot and slide with respect to the shaft 130.

The opposite or open end of the U-shaped control rod 154 is pivotably mounted to the control rod mounting bracket section 160 of the mounting bracket 112 by means of outwardly projecting pivot pins 158 formed in the ends of the control rod. The control rod mounting bracket 160 is vertically located on the mounting bracket 112 such that the loop end 156 of the control rod 154 is disposed substantially against the upper end of the guide slot 142 when the shaft 130 is retracted flush against the face of the door.

A tension spring mounting bracket 177 is formed in the lower end of the shaft slide 140, and one end of a tension spring 176 is mounted thereto. The other end of the tension spring 176 is mounted to the tension spring mounting bracket 178 formed in the lower end of the mounting bracket 112.

An outwardly depending latch member 169 below the shaft mounting bracket arm 116 defines an indentation 168 behind a beveled upper edge 172. A latch pin 165 extending through the shaft 130 parallel to the face of the door 14 is disposed to engage the indentation 168 when the shaft is retracted against the face of the door.

At the lower end of the shaft 130 is mounted a pivotable floor-engaging foot 180 similar to the one described in the first embodiment of the door security device. As previously described, a tension spring 182 urges the foot 180 into a retracted position when the foot is not in contact with the floor. Friction members 184 on the bottom of the foot 180 prevent the foot from skidding across the floor.

Mounting the door security device 110 of the second embodiment is greatly simplified in comparison to the mounting procedures required to install the first embodiment 10. Where the installation of the first embodiment 10 required the mounting of three separate components—the mounting bracket 12, the control rod bracket 60, and the tension spring mounting bracket 78—the mounting of this second embodiment 110 requires the mounting of only one component, the mounting bracket 112. The necessity for properly positioning the mounting bracket, the control rod bracket, and the tension spring bracket relative to one another is eliminated, since these three components are combined into one piece—mounting bracket 112. Accordingly, the possibility of the door security device not functioning properly because of improper installation is greatly eliminated. Furthermore, because the mounting bracket 112 is longer than the mounting bracket 12 of the first embodiment and is fastened at several points along its length, the door security device 110 is able to be more securely fastened to the face of the door.

The operation of the door security device 110 of the second embodiment is similar to the operation of the first embodiment 10. With the door closed, the user grasps the handle 134 and pulls the shaft 130 upwardly and outwardly. The upward force lifts the latch pin 165 out of the indentation 168 defined by the latch member 169 and permits the shaft to be pulled away from the face of the door 14. The outward force applied by the user causes the shaft 130 to pivot about its mounting pin 132 and the control rod 154 to pivot about its pivot pins 158. The downward force exerted by the tension spring 176 causes the shaft mounting pin 132 to slide downwardly in the slot 120 while maintaining the loop end 156 of the control rod 154 against the upper end of the longitudinal guide slot 142 while the control rod is in its first approximately 90 degrees of movement about its pivot pins 158.

As the angle of the control rod 154 relative to the shaft slide 140 passes the perpendicular, the downward and inward tension applied by the spring 176 causes the loop end 156 of the control rod 154 to slide downwardly within the longitudinal guide slot 142 in the direction indicated by the arrow 198 (FIG. 7). With the loop end 156 of the control rod 154 no longer acting against the upper end of the guide slot 142, the tension of the spring 176 pulls the shaft 130 downwardly, the shaft slide pin 132 sliding downwardly in the guide slot 120, until the floor-engaging foot 180 contacts the floor. The contact with the floor causes the foot to pivot, bringing the friction members 184 on the bottom of the foot into contact with the floor to prevent the foot from skidding. The downward and inward force exerted on the shaft 130 by the tension spring 176 urges the shaft slide pin 132 into the shoulder 124 in the bottom of the slot 120, thereby locking the shaft 130 in place.

To retract the door security device 110 of the second embodiment, the user grasps the handle 134 and pulls outwardly to disengage the shaft slide pin 132 from the shoulder 124 in the bottom of the guide slot 120. The user then pulls upwardly, causing the shaft slide pin 132 to move upwardly in its slot 120 and causing the control rod 154 to pivot about its pivot pin 158. As the shaft moves upwardly within the mounting bracket 112, the foot 180 is lifted off the floor, and the tension spring 182 urges the foot into a retracted position.

As the angle of the control rod 154 with respect to the shaft slide 140 passes the perpendicular, the inward force exerted by the tension spring 76 causes the loop end 156 of the control rod to slide upwardly to the top of the guide slot 142. As the shaft is lifted further, the arcuate movement of the control rod 154 about its pivot pins 158 pulls the shaft 130 toward the face of the door 14. The latch pin 165 contacts the beveled upper edge 172 of the latch member 169, urging the latch pin upwardly and over the latch member. The downward force of the tension spring 176 pulls the latch pin 165 downwardly into the indentation 168, thereby latching the device against the face of the door.

It will be appreciated by those skilled in the art that the door security device 10, 110 hereinbefore disclosed can secure an inwardly opening door against entry not only when the door is completely closed but also when the door is ajar. In this manner, a user could, if desired, secure the door in a partially open position, such as to provide ventilation or light.

For even greater security, or to secure outwardly opening doors against entry with either embodiment of the present invention, an alternate embodiment of a foot member 280 is disclosed in FIGS. 9A, B. The foot member 280 is mounted on the bottom of the shaft 30 or 130 in place of pivoting foot members 80, 180. A tab 284 is formed on the bottom of the foot 280. A foot-receiving anchor 290 has screw holes 292 formed therein for mounting the anchor to the floor. A slot 294 is defined in the upper surface of the anchor 290 to receive the tab 284 of the foot member 280.

To install the door security device of the present invention with the foot member 280, the device is mounted on the face of the door in the manner hereinbefore described. When it is determined where the foot member 280 will strike the floor, the anchor 290 is mounted at that point on the floor by screws (not shown) inserted through screw holes 292 in the anchor. With the door security device engaged, the tab 284 on the bottom of the foot 280 is received into the slot 294 in the anchor 290. If desired, the foot-receiving anchor 290 can be mounted flush with the floor so as not to obstruct normal pedestrian traffic.

It will further be appreciated that the door security device of the present invention can also be mounted within a vertical channel routed or otherwise formed in the door, so that the installed security device is flush with the face of the door for an attractive appearance.

Finally, it will be understood that the preferred embodiments of the present invention have been disclosed by way of example, and that other modifications may occur to those skilled in the art without departing from the scope and spirit of the appended claims.

What is claimed is:

1. A security device for mounting to the inside face of a door to engage the floor to prevent the door from being opened, comprising:

a shaft;

shaft mounting means mounted to the face of the door for slidably and pivotably mounting the upper end of said shaft such that the shaft can slide vertically within upper and lower limits and pivot relative to the door;

a control rod;

shaft slide means mounted to said shaft at an intermediate point for pivotably and slidably mounting a first end of said control rod such that said control rod can pivot and slide within upper and lower limits substantially parallel to the longitudinal axis of said shaft;

control rod mounting means for pivotably mounting a second end of said control rod to the door such that the first end of said control rod bears against the upper limit of said shaft slide means when the upper end of said shaft is substantially at the upper limit of said shaft mounting means;

means for urging the portion of said shaft below said shaft slide means downwardly and toward the face of the door;

whereby said security device is extendable to engage the floor by rotating said shaft about its upper end, said urging means urging said shaft downwardly so that said upper end of said shaft slides downwardly within its mounting means, and said urging means initially urging the first end of said control rod against said upper limit of said shaft slide means to support said intermediate point of said shaft against downward motion, and subsequently urging the first end of said control rod toward said lower limit of said shaft slide means to permit said intermediate point of said shaft to move downwardly, thereby bringing the lower end of said shaft into contact with the floor.

2. The security device of claim 1, further comprising a foot having a skid-resistant face, said foot being disposed at the lower end of said shaft such that said skid-resistant face engages the floor when said shaft is extended.

3. The security device of claim 2, wherein said floor-engaging foot is pivotably mounted to the lower end of said shaft such that said foot is pivoted by contact with the floor to bring said skid-resistant face into full contact with the floor when said shaft is extended.

4. The security device of claim 3, further comprising means for urging said foot to pivot into a retracted position such that said floor-engaging face of said foot is substantially parallel to the longitudinal axis of said shaft, whereby said foot is pivoted by contact with the floor to bring said skid-resistant face into full engagement with the floor, and whereby said urging means returns said foot to said retracted position when said foot is lifted away from the floor.

5. The security device of claim 1, further comprising latching means releasably securing said shaft in said retracted position.

6. The security device of claim 1, wherein said urging means comprises a coiled tension spring, the first end of which is attached to the face of the door at a point below said control rod pivot, and the second end of which is attached to the shaft at a point higher than the first end when said upper end of said shaft is at its lower vertical limit.

7. A security device for mounting on a substantially vertical door operable over a substantially horizontal floor and selectively engageable with said floor to selectively secure said door against undesired entry, said device comprising:

a shaft slidably and pivotably mounted to said door at one end thereof and including means for engaging said floor at the other end thereof, said shaft being pivotable between a storage position substantially parallel to said door and an extended position wherein said shaft and said door form an acute angle therebetween, said shaft being slidable between an upper position wherein said floor engaging means does not engage said floor and a lower position wherein said floor engaging means engages said floor;

a control linkage pivotably attached to said door at one end thereof and to said shaft at the other end thereof intermediate the opposite ends of said shaft;

said shaft and said control linkage being constructed and arranged such that said control linkage urges said shaft from said retracted position to said extended position as said shaft moves from said extended position as said shaft moves from said upper position to said lower position, whereby said shaft moves in an arcuate motion from said upper storage position such that said door is operable, to said lower extended position such that said door is secured against opening by the bracing action of said shaft.

8. The device of claim 7, further comprising means for urging said shaft from said upper position to said lower position.

9. The device of claim 7, further comprising means for locking said shaft in said lower extended position.

* * * * *